US008313583B2

(12) United States Patent
May et al.

(10) Patent No.: US 8,313,583 B2
(45) Date of Patent: Nov. 20, 2012

(54) VENTED DOOR ASSEMBLY FOR A DISHWASHER

(75) Inventors: Brian W. May, Saint Joseph, MI (US); Michelle L. Oakes, Flagstaff, AZ (US); Ryan Kevin Roth, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 994 days.

(21) Appl. No.: 12/340,788

(22) Filed: Dec. 22, 2008

(65) Prior Publication Data

US 2010/0156259 A1 Jun. 24, 2010

(51) Int. Cl.
*B08B 3/00* (2006.01)

(52) U.S. Cl. ..... 134/56 D; 134/57 D

(58) Field of Classification Search ..... 49/391; 134/56 D

See application file for complete search history.

(56) References Cited

U.S. PATENT DOCUMENTS

| | | | | |
|---|---|---|---|---|
| 1,757,987 | A | 5/1930 | Whittier | |
| 3,092,122 | A | 6/1963 | Guth | |
| 3,292,645 | A * | 12/1966 | Braden et al. | 134/57 D |
| 3,409,005 | A | 11/1968 | Field | |
| 5,178,172 | A | 1/1993 | Morley | |
| 5,660,195 | A | 8/1997 | Taylor, Jr. et al. | |
| 5,836,324 | A | 11/1998 | Johnson et al. | |
| 5,881,746 | A | 3/1999 | Buser et al. | |
| 6,138,692 | A | 10/2000 | Kobos et al. | |
| 6,293,289 | B1 | 9/2001 | Hapke et al. | |
| 6,913,296 | B2 * | 7/2005 | Bassi | 292/122 |

FOREIGN PATENT DOCUMENTS

JP 2000126107 A 5/2000

* cited by examiner

*Primary Examiner* — Michael Barr
*Assistant Examiner* — Jason Ko
(74) *Attorney, Agent, or Firm* — Jacquelyn R. Lin; Diederiks & Whitelaw PLC

(57) ABSTRACT

A dishwasher includes a door assembly that has an outer door panel with a vent. At the end of a wash cycle, the outer door panel tips outwardly to expose the vent. Steam is evacuated from the dishwasher through the vent via a duct extending through the door assembly.

20 Claims, 5 Drawing Sheets

VENTED DOOR ASSEMBLY FOR A DISHWASHER

TECHNICAL FIELD

The present disclosure relates generally to a dishwasher and more particularly to a vented door assembly for a dishwasher.

BACKGROUND

A dishwasher is a domestic appliance into which dishes and other cooking and eating wares (e.g., plates, bowls, glasses, flatware, pots, pans, bowls, etcetera) are placed to be washed. A dishwasher includes a tub having a number of dish racks onto which such wares are loaded. A hinged door provides user access to the dish racks located in the tub.

SUMMARY

According to one aspect, a dishwasher includes a tub defining a washing chamber having a number of dishwashing racks positioned therein. The tub has an access opening defined in the front to permit user access to the racks positioned in the washing chamber. A door assembly is secured to the tub. The door assembly is movable between a closed position in which the door assembly prevents user access to the racks positioned in the washing chamber, and an open position in which user access is permitted to the racks positioned in the washing chamber. The door assembly has an inner door panel that seals the access opening when the door assembly is closed, and an outer door panel that pivots about the inner door panel. The outer door panel has a vent. A steam evacuation duct extends from the inner door panel to the vent of the outer door panel.

The inner door panel covers the entire access opening of the tub when the door assembly is closed.

The outer door panel pivots about the inner door panel between a closed vent position in which steam is prevented from escaping from the tub through the vent, and an open vent position in which steam is permitted to escape from the tub through the vent.

The dishwasher may also include a latch that is configured to retain the outer door panel in the closed vent position.

The dishwasher may also include a spring positioned between the inner door panel and the outer door panel. The spring urges the outer door panel into the open vent position when the latch is positioned in an open latch position.

The latch retains the outer door panel in the closed vent position when the latch is positioned in the closed latch position.

The lower end of the inner door panel pivots about the tub, whereas a lower end of the outer door panel pivots about the inner door panel.

The steam evacuation duct may include an inlet pipe that has a first end that is secured to the inner door panel and a second end that extends toward the outer door panel. It may also have an outlet pipe that includes a first end that is coupled to the second end of the inlet pipe and a second end that is coupled to the vent in the outer door panel.

The first end of the outlet pipe and the second end of the inlet pipe are telescoped with one another.

The dishwasher may also include a control panel secured to an upper end of the inner door panel.

According to another aspect, a dishwasher door assembly includes a control console that has a number of dishwasher controls, an inner door panel secured to the control console, and an outer door panel that pivots about the inner door panel.

The outer door panel has a vent. A steam evacuation duct extends from the inner door panel to the vent of the outer door panel. The steam evacuation duct includes an inlet pipe secured to the inner door panel and an outlet pipe secured to the outer door panel.

The outlet pipe may be coupled to the vent.

The outlet pipe and the inlet pipe may telescope with one another.

The inner door panel may be sized to seal to an entire outer periphery of a user access opening of a dishwasher.

The outer door panel pivots about the inner door panel between a closed vent position in which steam is prevented from escaping from the inlet pipe through the vent, and an open vent position in which steam is permitted to escape from the inlet pipe through the vent.

The door assembly may also include a latch that is configured to retain the outer door panel in the closed vent position.

The door assembly may also include a spring positioned between the inner door panel and the outer door panel. The spring urges the outer door panel into the open vent position when the latch is positioned in an open latch position.

The latch retains the outer door panel in the closed vent position when the latch is positioned in the closed latch position.

The outer door panel and the inner door panel may be of the same width.

The control console and the outer door panel may be of the same width.

BRIEF DESCRIPTION OF THE DRAWINGS

The detailed description particularly refers to the following figures, in which.

DETAILED DESCRIPTION OF THE DRAWINGS

Figure 1:
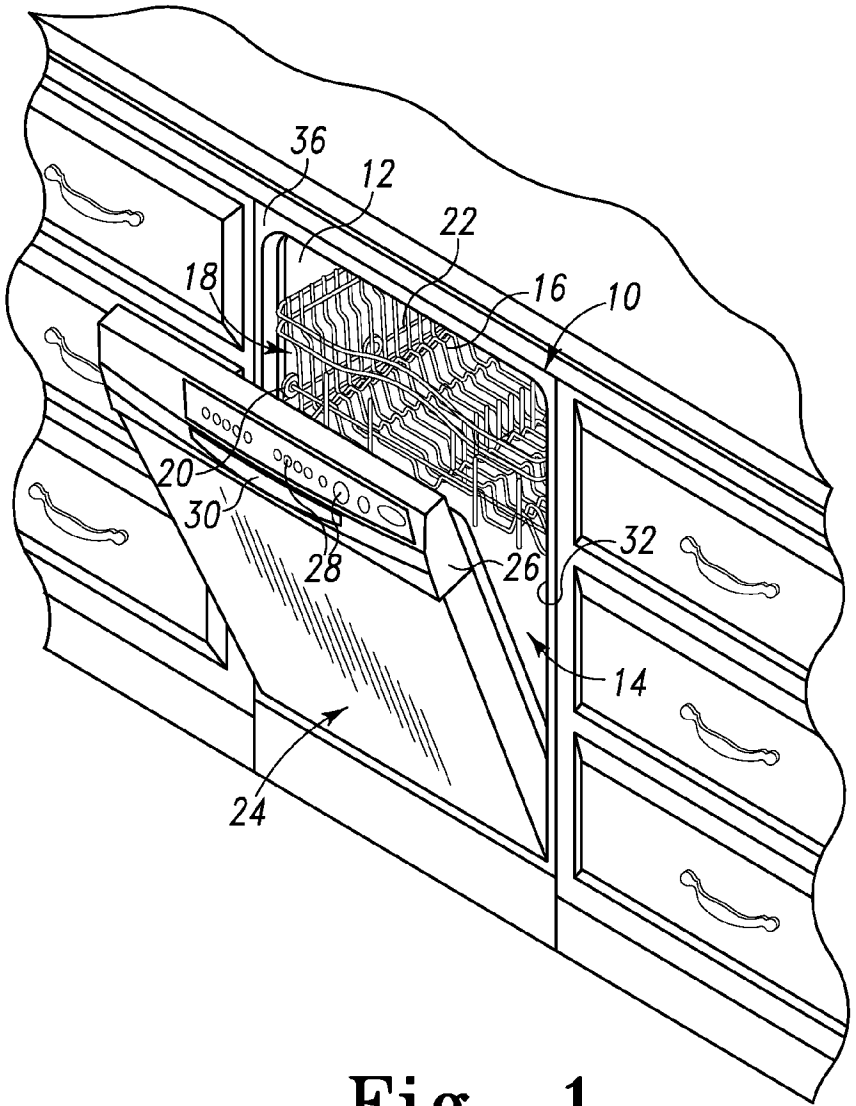
FIG. 1 is fragmentary perspective view of a dishwasher installed in a kitchen cabinet.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, there is shown a dishwasher 10 having a tub 12 which defines a washing chamber 14 into which dishes and other cooking and eating wares (e.g., plates, bowls, glasses, flatware, pots, pans, bowls, etcetera) are placed to be washed. The dishwasher 10 includes a number of racks 16 located in the tub 12. An upper dish rack 16 is shown in FIG. 1, although a lower dish rack is also included in the dishwasher 10. A number of roller assemblies 18 are positioned between the dish rack 16 and the tub 12. The roller assemblies 18 allow the dish racks 16 to extend from, and retract back into, the tub 12. Such movement facilitates the loading and unloading of the dish racks 16. The roller assemblies 18 include a number of rollers 20 which roll along the top of, and in some cases the top and bottom of, a corresponding support rail 22.

A door assembly 24 is hinged to the lower front edge of the tub 12. The door assembly 24 permits access to the tub 12 to load and unload the dishwasher 10. In such a way, the open front side of the tub 12 defines the access opening 32 of the dishwasher 10. User access to the dish racks 16 positioned in the washing chamber 14 is provided through the access opening 32. As used herein, the term "access opening" is intended to mean the opening formed in the front side of the tub through which a user of the dishwasher gains access to the dish racks to, for example, load and unload the same. As such, when the door assembly 24 is closed, user access to the dish racks 16 is prevented, whereas user access to the dish racks 16 is permitted with the door assembly 24 is open. The door assembly 24 also functions to seal the dishwasher 10 so that water does not escape the access opening 32 of the dishwasher 10 during a wash cycle.

A control console 26 is located at the top of the door assembly 24. The control console 26 includes a number of controls 28, such as buttons and knobs, that are used to control operation of the dishwasher 10. A handle 30 is also included in the control console 26. The handle 30 is operable by a user to unlatch the door assembly 24 so that it may be opened by a user.

Figure 2:
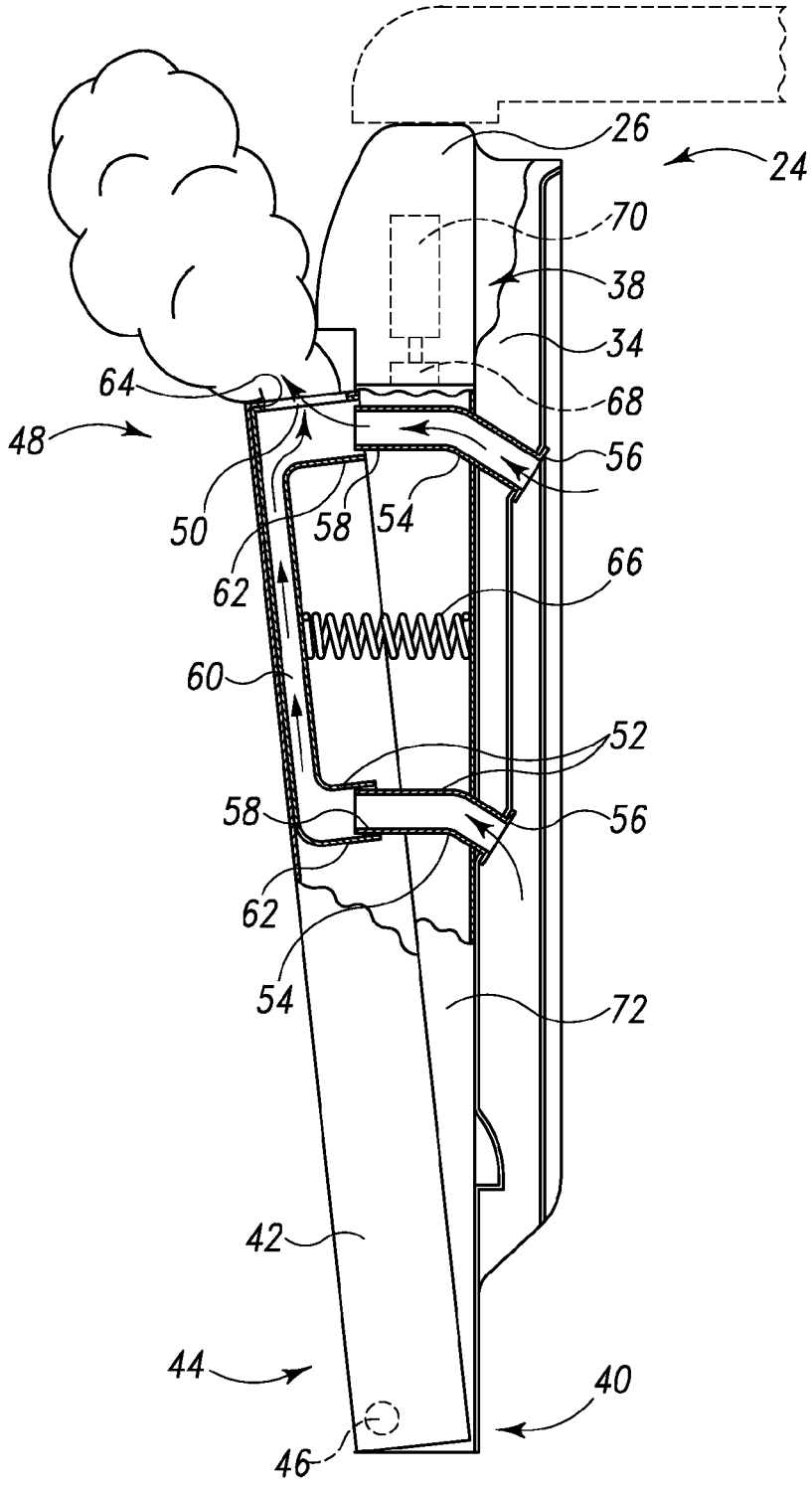
FIG. 2 is a fragmentary cross sectional view of the door assembly of the dishwasher of FIG. 1, note the outer door panel is positioned in its open vent position.
Figure 3:
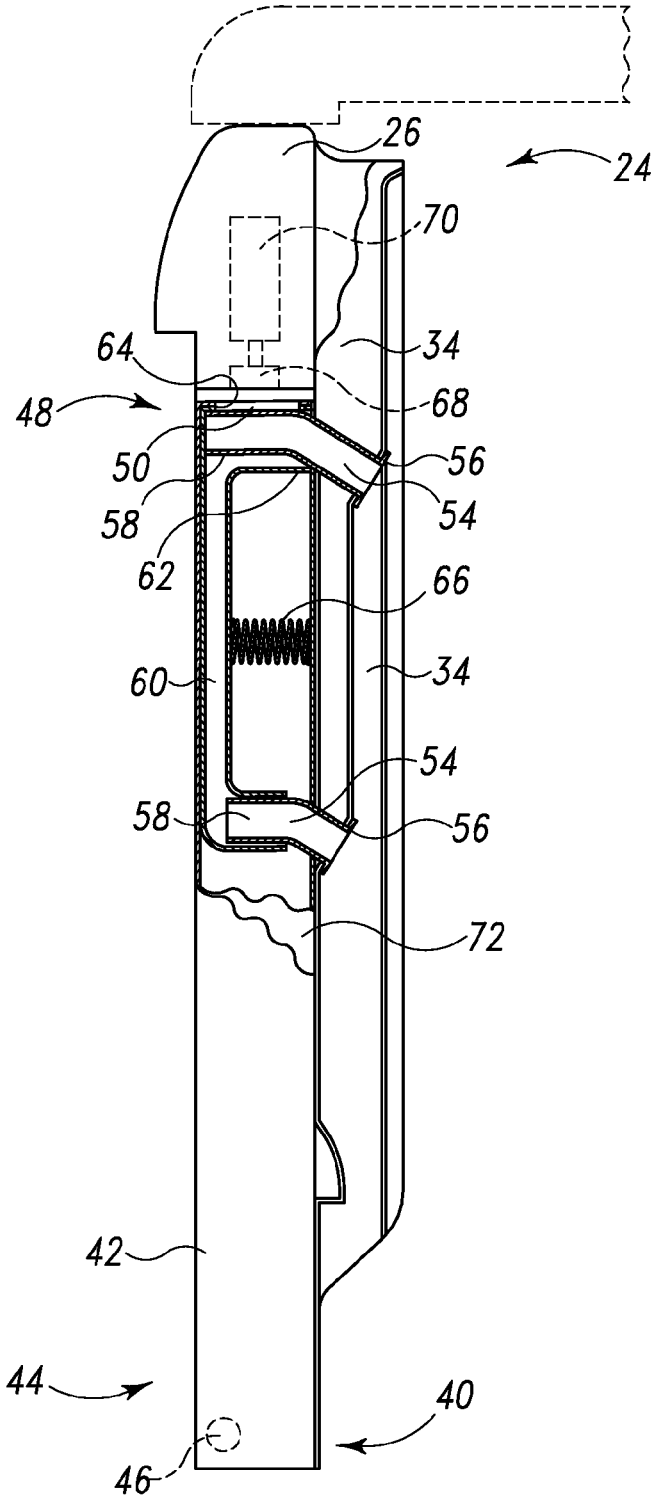
FIG. 3 is a view similar to FIG. 2, but showing the outer door panel positioned in its closed vent position.

Referring now to FIGS. 2 and 3, there is shown the door assembly 24 in more detail. The door assembly 24 includes an inner door panel 34. The inner door panel 34 engages the frame 36 of the tub 12 to seal the entire access opening 32 when the door assembly 24 is closed. A number of seals (not shown) may be positioned between the inner door panel 34 and the frame 36 of the tub 12 to facilitate such a sealing arrangement.

The control console 26 is secured to the upper end 38 of the inner door panel 34. The lower end 40 of the inner door panel 34 pivots relative to the lower edge of the tub 12. It should be appreciated that the lower door panel 34 may be secured to the lower edge of the tub 12 by the use of a number of hinges (not shown) to pivot in such a manner.

Figure 4:
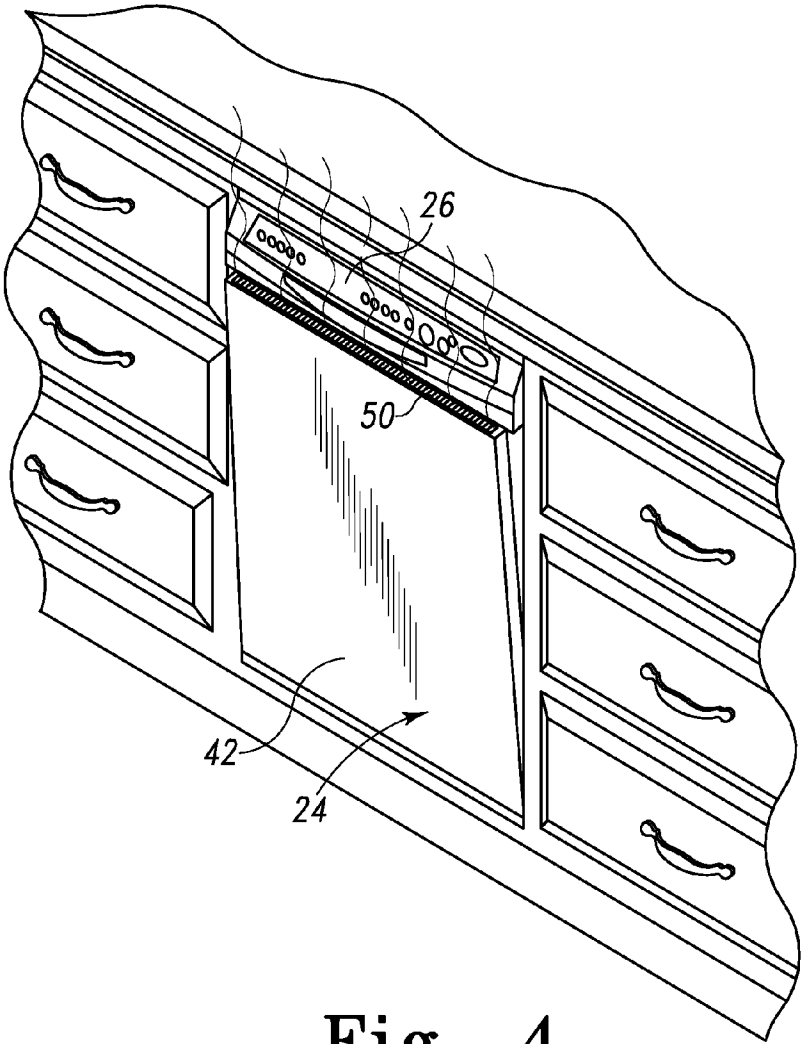
FIG. 4 is a view similar to FIG. 1, but showing the door assembly positioned in the closed position and the outer door panel positioned in its open vent position.

The door assembly 24 also includes an outer door panel 42. The outer door panel 42 extends from the control console 26 downwardly to the lower end 40 of the inner door panel 34. As shown in FIG. 4, in the illustrative embodiment described herein, the control console 26 and the outer door panel 42 have the same width. In other words, the control console 26 extends substantially across the entire width of the outer door panel 42. Similarly, the outer door panel 42 and the inner door panel 34 have the same width. As shown in FIG. 1, the outer door panel 42 tips outwardly along with the inner door panel 34 when the door assembly 24 is opened.

The lower end 44 of the outer door panel 42 pivots relative to the lower end 38 of the inner door panel 34 about a pivot 46. The pivot 46 may be embodied as a short shaft or pin extending between the two door panels 34, 42. Alternatively, the pivot 46 may be embodied as one or more hinges or some other pivot-type assembly.

The upper end 48 of the outer door panel 42 includes a vent 50. As shown in FIG. 4, the vent 50 extends across substantially the entire width of the outer door panel 42. The vent 50 is operable to quickly evacuate steam accumulated in the tub 12 of the dishwasher 10 thereby allowing the dishes or other wares located in the washing chamber 14 to be quickly dried (i.e., "flash dried") at the end of a cleaning cycle. In many embodiments, such flash drying eliminates the need to use a heating element to dry the dishes or other wares thereby providing a desirable energy savings.

As shown in FIGS. 2 and 3, a steam evacuation duct 52 extends from the inner door panel 34 to the vent 50 of the outer door panel 42. The evacuation duct 52 functions as a fluid path that allows steam to escape from the tub 12 of the dishwasher 10 when the outer door panel 42 is tipped open (i.e., positioned in the open vent position shown in FIG. 2). The evacuation duct 52 includes a pair of inlet pipes 54. An intake end 56 of each of the inlet pipes 54 is secured to the inner door panel 34. The inlet pipes 54 extend outwardly from their intake end 56 in the direction toward the outer door panel 42 such that an exhaust end 58 of each the inlet pipes 54 extends into the outer door panel 42.

An outlet pipe 60 is positioned in the outer door panel 42. The outlet pipe 60 has a pair of intake ends 62 that receive the exhaust ends 58 of the inlet pipes 54. The inlet pipes 54 and the outlet pipe 60 telescope with one another when outer door panel 42 pivots relative to the inner door panel 34. In particular, in the illustrative embodiment described herein, the exhaust ends 58 of the inlet pipes 54 are received into the intake ends 62 of the outlet pipe 60. The exhaust ends 58 remain stationary when the outer door panel 42 pivots relative to the inner door panel 34. However, the intake ends 62 of the outlet pipe 60 move back and forth relative the exhaust ends 58 of the inlet pipes 54 as the outer door panel 42 pivots relative to the inner door panel 34.

As shown in FIG. 2, the vent 50 is positioned in an exhaust port 64 of the outlet pipe 60. The exhaust port 64 defines the outlet of the steam evacuation duct 52.

When the outer door panel 42 is positioned in its open vent position (as shown in FIG. 2), steam is evacuated from the tub 12 of the dishwasher 10 via a fluid path that includes the inlet pipes 54, the outlet pipe 60, and the vent 50. Specifically, steam exiting the tub 12 enters the intake ends 56 of the inlet pipes 54, flows through the inlet pipes 54, and exits the inlet pipes 54 through the exhaust ends 58 thereof. Steam exiting the exhaust ends 58 of the inlet pipes 54 enters the intake ends 62 of the outlet pipe 60 where it is advanced through the body of outlet pipe 60 toward its exhaust port 64. Steam exits the exhaust port 64 and is expelled into the atmosphere through the vent 50. As shown in FIGS. 2 and 4, the configuration of the vent 50 allows steam to be evacuated from the dishwasher 10 without moisture accumulating under the countertop (shown in phantom in FIG. 2) or in the associated cabinets. In particular, the vent 50 extends outwardly to a position beyond the lower surface of the countertop thereby allowing the escaping steam to be released without being impinged on the lower surface of the countertop.

Conversely, as shown in FIG. 3, when the outer door panel 42 is positioned in its closed vent position, the vent 50 is sealed against a surface located under the control console 26. This prevents steam from escaping the tub 12 of the dishwasher 10 through the vent 50.

In the illustrative embodiment described herein, a biasing element such as a spring 66 is positioned between the inner door panel 34 and the outer door panel 42. The spring 66 exerts of a spring bias on the outer door panel 42 to facilitate movement of the outer door panel 42 from its closed vent position (see FIG. 3) to its open vent position (see FIG. 2). Movement of the outer door panel 42 in such a manner is controlled by the position of a latch 68. In the illustrative embodiment described herein, the latch 68 is embodied as a normally closed-type latch which locks the outer door panel 42 in its closed vent position. As shown in FIG. 3, when positioned in such a position, the spring 66 is compressed. An actuator, such as a wax motor 70, is operable to open the latch 68 (i.e., move it from its normally closed position to its open position) thereby releasing the outer door panel 42. When the latch 68 is opened in such a manner, the spring 66 urges the outer door panel 42 from its closed vent position (see FIG. 3) to its open vent position (see FIG. 2) thereby allowing steam to be evacuated from the tub 12 of the dishwasher 10. Once the steam has escaped, a user may urge the upper end 48 of the outer door panel 42 closed (i.e., back toward the control console 26) where it is captured by the latch 68 thereby locking the outer door panel 42 in its closed vent position.

As shown in FIG. 2, the door assembly 42 also includes a pair of side shields 72. The side shields 72 shield the inner components of the door assembly 42 (e.g., the steam evacuation duct 52 and the spring 66). It should be appreciated that in lieu of the side shields 72, an intermediate panel that envelopes such inner components could be used.

In operation, the racks 16 of the dishwasher 10 may be loaded with dishes and other cooking and eating wares. The door assembly 24 is then closed such that the access opening 32 is sealed and a wash cycle is commenced. At the completion of a wash cycle, the controller associated dishwasher 10 signals or otherwise actuates the wax motor 70 thereby opening the latch 68 (i.e., moving it from its normally closed position to its open position). When the latch 68 is opened in such a manner, the outer door panel 42 is released and the spring 66 urges the outer door panel 42 from its closed vent position (see FIG. 3) to its open vent position (see FIGS. 2 and 4).

Once the outer panel is opened in such a manner, steam is evacuated from the tub 12 of the dishwasher 10 via the steam evacuation duct 52. Specifically, steam exiting the tub 12 enters the intake ends 56 of the inlet pipes 54, flows through the inlet pipes 54, and exits the inlet pipes 54 through the exhaust ends 58 thereof. Steam exiting the exhaust ends 58 of the inlet pipes 54 enters the intake ends 62 of the outlet pipe 60 where it is advanced through the body of outlet pipe 60 toward its exhaust port 64. Steam exits the exhaust port 64 and is expelled into the atmosphere through the vent 50. Such rapid expulsion of the steam within the tub 12 rapidly dries (i.e., "flash dries") the dishes and other wares in the dishwasher 10. Such flash drying of the dishes and other wares may be used to supplement a heated dry cycle or may allow for the elimination of a heated dry cycle altogether.

Once the steam has escaped, a user may the urge (i.e., push) the upper end 48 of the outer door panel 42 closed (i.e., back toward the control console 26) where it is captured by the latch 68. This locks the outer door panel 42 in its closed vent position (as shown in FIG. 3). The user may then use the handle 30 located on the control console 26 to open the door assembly 24 (as shown in FIG. 1) thereby permitting user access to the tub 12. The user may then unload the newly cleaned dishes and other wares located in the racks 16.

It should be appreciated that such a configuration increases the aesthetics of the dishwasher 10. Namely, when the outer door panel 42 is positioned in its closed vent position (as shown in FIG. 3), the vent 50 is concealed from the view of the user. The vent 50 is only visible to the user for the period of time in which the outer door panel 42 is positioned in its open vent position (see FIGS. 2 and 4).

Figure 5:
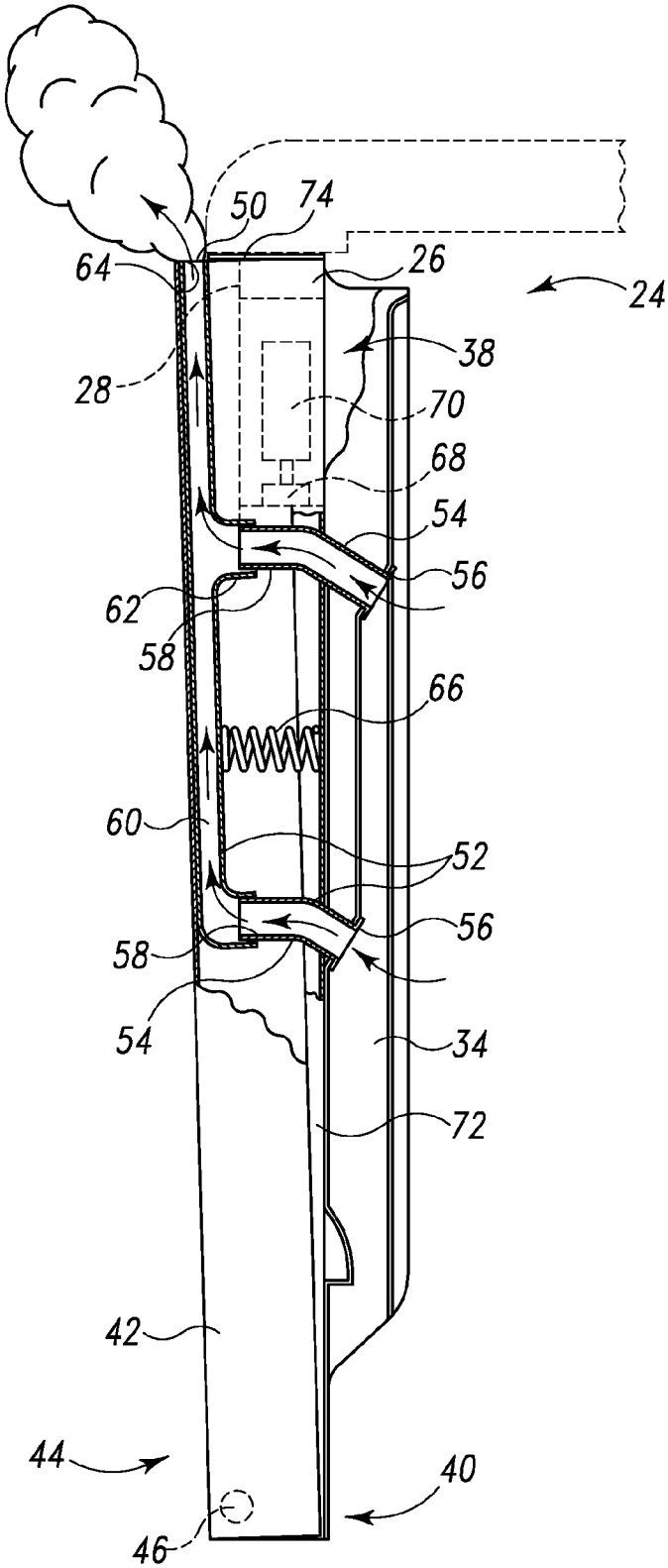
FIG. 5 is view similar to FIG. 2, but showing a door assembly for use with a version of a dishwasher with controls integrated into the upper surface of the door.

Referring now to FIG. 5, there is show another embodiment of the door assembly 24. The door assembly 24 shown in FIG. 5 is substantially identical to the door assembly of FIGS. 1-4 except that it is configured for use in the construction a dishwasher with controls integrated into the upper surface of the door. As such, the controls 28 of the control console 26 are accessed from a top surface 74 of the door assembly 24. It should be appreciated that in such a configuration, the design of the vent 50 may be altered to direct the flow of steam away from certain of the components of the control console 26. Like the door assembly of FIGS. 1-4, the configuration of the vent 50 of the door assembly of FIG. 5 allows steam to be evacuated from the dishwasher 10 without moisture accumulating under the countertop (shown in phantom in FIG. 5) or in the associated cabinets. In particular, the vent 50 extends outwardly to a position beyond the lower surface of the countertop thereby allowing the escaping steam to be released without being impinged on the lower surface of the countertop.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

The invention claimed is:

1. A dishwasher, comprising:

a tub defining a washing chamber having a number of dishwashing racks positioned therein, the tub having an access opening defined in the front thereof to permit user access to the number of racks positioned in the washing chamber, and a door assembly secured to the tub, the door assembly being movable between (i) a closed position in which the door assembly prevents user access to the number of racks positioned in the washing chamber, and (ii) an open position in which user access is permitted to the number of racks positioned in the washing chamber, the door assembly comprising:

an inner door panel that seals the access opening when the door assembly is positioned in the closed position, an outer door panel that pivots about the inner door panel, the outer door panel being formed with an opening defining a vent, and a steam evacuation duct extending from the inner door panel to the vent of the outer door panel, wherein the outer door panel pivots about the inner door panel between (i) a closed vent position in which steam is prevented from escaping from the tub through the vent, and (ii) an open vent position in which steam is permitted to escape from the tub through the vent.

2. The dishwasher of claim 1, wherein the inner door panel covers the entire access opening of the tub when the door assembly is positioned in the closed position.

3. The dishwasher of claim 1, wherein the outer door panel includes an upper end which is exposed only when the outer door panel is in the open vent position, said vent being provided in the upper end.

4. The dishwasher of claim 3, further comprising a latch, wherein the latch is configured to retain the outer door panel in the closed vent position.

5. The dishwasher of claim 4, further comprising a spring positioned between the inner door panel and the outer door panel, wherein:

the latch has an open latch position and a closed latch position, the spring urges the outer door panel into the open vent position when the latch is positioned in the open latch position, and the latch retains the outer door panel in the closed vent position when the latch is positioned in the closed latch position.

6. The dishwasher of claim 3, wherein:

the vent is concealed from a view of a user when the outer door panel is positioned in the closed vent position, and the vent is visible to the user when the outer door panel is positioned in the open vent position.

7. The dishwasher of claim 1, wherein:

a lower end of the inner door panel pivots about the tub, and a lower end of the outer door panel pivots about the inner door panel.

8. The dishwasher of claim 1, wherein the steam evacuation duct comprises:

an inlet pipe having a first end that is secured to the inner door panel and a second end that extends toward the outer door panel, and an outlet pipe having a first end that is coupled to the second end of the inlet pipe and a second end that is coupled to the vent.

9. The dishwasher of claim 8, wherein the first end of the outlet pipe and the second end of the inlet pipe are telescoped with one another.

10. The dishwasher of claim 1, further comprising a control console fixedly secured to a top portion of the inner door panel, above the outer door panel, said control console having a number of dishwasher controls.

11. A dishwasher door assembly, comprising:

a control console having a number of dishwasher controls, an inner door panel, an outer door panel mounted for pivotal movement relative to both the inner door panel and the control console, the outer door panel being formed with an opening defining a vent, and a steam evacuation duct extending from the inner door panel to the vent of the outer door panel.

12. The door assembly of claim 11, wherein the steam evacuation duct comprising an inlet pipe secured to the inner door panel and an outlet pipe secured to the outer door panel.

13. The door assembly of claim 12, wherein the outlet pipe and the inlet pipe are telescoped with one another.

14. The door assembly of claim 11, wherein the inner door panel is sized to seal to an entire outer periphery of a user access opening of a dishwasher.

15. The door assembly of claim 12, wherein the outer door panel pivots about the inner door panel between (i) a closed vent position in which steam is prevented from escaping from the inlet pipe through the vent, and (ii) an open vent position in which steam is permitted to escape from the inlet pipe through the vent.

16. The door assembly of claim 11, further comprising a latch, wherein the latch is configured to retain the outer door panel in a closed vent position.

17. The door assembly of claim 16, further comprising a spring positioned between the inner door panel and the outer door panel, wherein:

the latch has an open latch position and a closed latch position, the spring urges the outer door panel into an open vent position when the latch is positioned in the open latch position, and the latch retains the outer door panel in the closed vent position when the latch is positioned in the closed latch position.

18. The door assembly of claim 15, wherein:

the vent is concealed from a view of a user when the outer door panel is positioned in the closed vent position, and the vent is visible to the user when the outer door panel is positioned in the open vent position.

19. The door assembly of claim 11, wherein the outer door panel, the inner door panel and the control console are of the same width, with the inner door panel being fixedly secured to the control console.

20. The door assembly of claim 12, wherein the outlet pipe is coupled to the vent.

* * * * *